United States Patent [19]

Krogsrud

[11] 4,417,345

[45] Nov. 22, 1983

[54] HOLDER FOR AN ELECTRODE

[75] Inventor: Harald Krogsrud, Gjettum, Norway

[73] Assignee: Elkem a/s, Oslo, Norway

[21] Appl. No.: 281,720

[22] Filed: Jul. 9, 1981

[30] Foreign Application Priority Data

Jul. 25, 1980 [NO] Norway ..... 802263

[51] Int. Cl.[3] ..... H05B 7/10

[52] U.S. Cl. ..... 373/101; 373/96

[58] Field of Search ..... 373/94, 96, 100, 101, 373/89

[56] References Cited

U.S. PATENT DOCUMENTS 2,982,804 5/1961 Reschke ..... 373/101 X

FOREIGN PATENT DOCUMENTS 2125773 12/1972 Fed. Rep. of Germany ..... 373/96

*Primary Examiner*—Roy N. Envall, Jr.

*Attorney, Agent, or Firm*—Eyre, Mann, Lucas & Just

[57] ABSTRACT

A holder assembly (2) for an electrode (1) in an electrothermal smelting furnace is movable suspended from a suspension means and comprises a plurality of contact clamps (3) which are pressed towards the electrode (1) by means of pressure producing means and an externally arranged thrust member (5). The holder assembly (2) is further equipped with means for supplying current to the electrode. The thrust member (5) is formed of the cooling shield which surrounds the electrode and the holder assembly. On the inner surface of the cooling shield (5) a plurality of vertical, current conducting rails (7) are arranged. Sliding contacts (10) arranged on the pressure producing means (4) are thrusted against the rails, providing proper electrical contact. The rails (7) are preferably insulated from the shield (5). The shield (5) may preferably be stationary arranged with respect to the electrode and constitute an integral part of the furnace roof/hood (6).

7 Claims, 2 Drawing Figures

HOLDER FOR AN ELECTRODE

Figure 1:
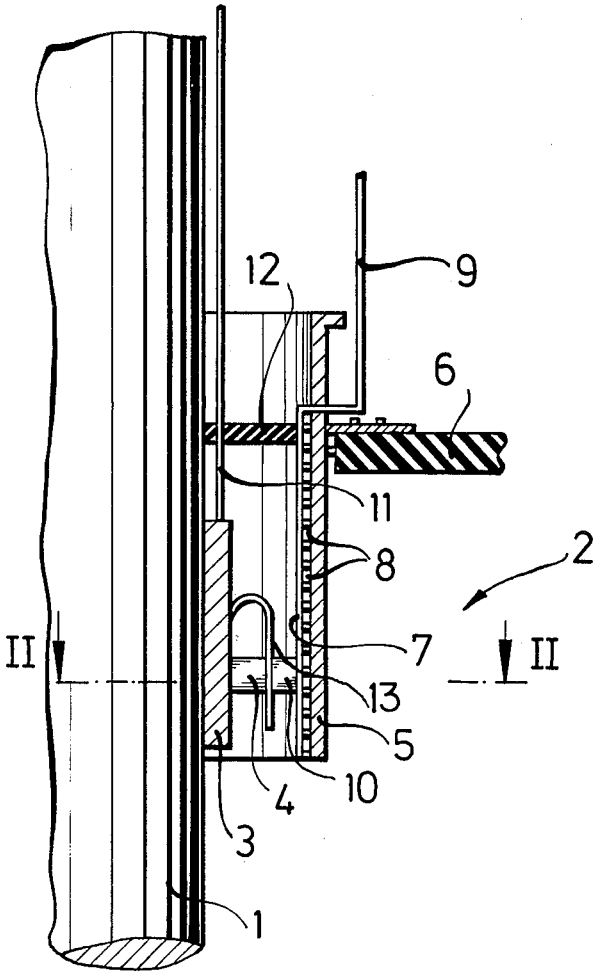

The present invention relates to a holder assembly for an electrode in an electrothermal smelting furnace where the holder assembly is movably suspended from a suspension means. The holder assembly comprises a plurality of contact clamps or contact sections which are pressed against the electrode by means of one or more pressure producing means and an externally arranged member extending circumferentially around the electrode. The holder assembly is further provided with means for conducting current to the electrode. In particular, but not exclusively, the present invention is suitable for use in conjunction with closed furnaces equipped with a furnace roof, enabling unburned CO-gas to be controllably vented from the furnace. Holder assemblies of this type impose radial forces on to the electrode.

With a device of this type it is important to provide sufficient contact pressure between the holder assembly and the electrode. Further, such holder assembly should be as simple and rigid as possible, reducing the required down-time of the furnace due to maintenance as much as possible. Further, the various parts of the holder assembly should be easy to remove and to substitute spare parts therefor. Further, the necessity of cooling structural parts of the furnace or in its surroundings should be reduced to a minimum.

Traditionally, current is conducted to the electrode holder assembly through flexible conductors, for example by a plurality of flexible cables or strings, these being either dry or water cooled. The dependency on flexible conductors represent a large drawback, mainly since these require large space and frequent maintenance due to heavy wear. Such maintenance requires complete close down of the furnace.

The conventional holder assembly as such functions satisfactory. However, the traditional holder assembly is no longer competitive from a production and maintenance point of view.

According to the present invention the pressure producing means constitute an integral part of the contact clamps, while the externally arranged members surrounding the contact clamps serve as a thrust element, enabling the contact clamps to be pressed towards the electrode. At its inner surface the externally arranged thrust member which also serves as a water cooled shield is provided with a plurality of current conducting rails, against which a contact member on the pressure producing means is arranged in slidable contact. The rails are preferably electrically insulated from the shield and the contact pressure between the clamps and the rails are provided by forcing the sliding contacts against the rails. For this operation, the pressure producing means which press the contact clamps against the electrode, are preferably used. According to one preferred embodiment, the cooling shield is fixed so that it is stationary with respect to the electrode and constitutes an integral part of the gas tight furnace roof/smoke hood of the furnace. The cooling shield extends down through the roof/hood to a level below the lower level where the contact clamps are intended to be lowered during normal operation of the furnace. The cooling shield is insulated, made gas tight and is physically fixed to the hood/roof. The cooling shield extends preferably up through and above the hood/roof.

The number of current conducting rails corresponds substantially to the number of contact clamps or constitutes a multiple of said number of contact clamps. Current conducting rails are arranged on the internal surface of the shield, the rails being arranged radially adjacent the center of each pressure producing means. The pressure producing means, which preferably form an integral part with the contact clamps, press a slidably arranged contact body on the clamps against the rails on the cooling shield. When the pressure producing means are activated, said means will thrust both the contact clamps against the electrodes and the sliding contact body against the current conducting rails, arranged on the internal surface of the cooling shield. In this way a direct electric contact will be provided between the current conducting rails on a cooling shield and the electrode. The cooling shield will during this stage serve as a thrust member for the pressure producing means. The vertical current conducting rails on the cooling shield may preferably be connected to a current supply source through a rigid and permanent connection in contrast to the traditional flexible connections.

During the vertical movement of the electrode, the electrode will receive current through said sliding contact.

The present invention is described in conjunction with a stationary cooling shield. It should be appreciated, however, that the present invention is not limited to such use, but may be used also in conjunction with a cooling shield arranged to be movable relative to the hood/furnace roof. In the latter case conventional flexible connections are required between the current source and the current conducting rails on the cooling shield.

One preferred embodiment of the present invention will now be described in further detail in conjunction with the figures, wherein FIG. I shows a vertical section seen along the line 1—1 on FIG. II, the section being seen through an electrode with a holder assembly according to the present invention; and FIG. II shows a horizontal section seen along the line 2—2 on FIG. I.

FIG. I shows a vertical section through one half of an electrode 1 with an electrode holder assembly 2. The electrode holder assembly 2 comprises a plurality of contact clamps 3 which are evenly distributed along the circumference of the electrode 1, the contact clamps being pressed by means of suitable pressure producing means 4 against the electrode 1, thereby providing sufficient electric contact. As a thrust member for the pressure producing means 4, an externally arranged cooling shield 5 is used. The shield 5 is stationary arranged with respect to the electrode 1, the shield 5 forming an integral unit with a gas tight furnace roof or a smoke hood.

The cooling shield 5 has a vertical extension and is arranged in such a way relative to the hood/roof 6 that the shield 5 extends down into the furnace to a level which is below the level where the contact clamps 3 are designed to be moved during normal operation of the furnace. A plurality of vertical current conducting rails 7 are arranged on the internal surface of the cooling shield 5. The rails 7 are electrically insulated from the cooling shield 5 by means of insulating means, indicated by the reference number 8. The rails 7 have a vertical extension which substantially corresponds to the height which the contact clamps 3 are intended to be moved during normal operation of the furnace. At its upper end the rails 7 are connected with current supply lines (not shown) by means of electric connection means 9. Current is conducted from the rails 7 to the contact clamps through a sliding contact 10. The sliding contacts 10 are connected to and moved in radial direction of the electrode by means of the pressure producing means 4. The contact clamps 3 and the sliding contact 10 receive the contact pressure from the pressure producing means 4. The contact clamps 3 are suspended from a frame (not shown) by means of a suitable suspension means 11.

Figure 2:
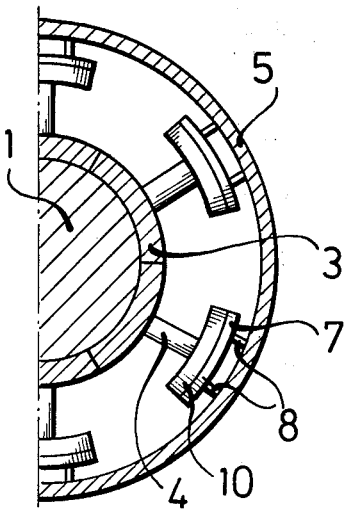

The contact clamps 3 and the pressure producing means 4 are further provided with pipes (e.g. pipe 13) for supply of coolant and/or a pressure agent. However, since these features do not constitute a part of the present invention, these features are not shown in FIG. 2 for reasons of clarity. Nor is any of the conventional accessory equipment which is used to move the electrode up and/or down shown or described. At its upper end the holder assembly is equipped with a gas tight sealing 12.

The holder assembly in accordance with the present invention may both be used on electrodes of the prebaked type and on self-baking electrodes such as for instance "Søderberg" electrodes.

I claim:

1. An electrode holder assembly for an electrode of an electrothermal smelting furnace comprising an external cooling shield operative also as a thrust member; a plurality of vertically-extending, current-conducting rails disposed on said cooling shield along an inner surface thereof; a plurality of contact clamps for clamping against an electrode; pressure producing means including a contact section slidable on said current-conducting rails; said pressure producing means being arranged between said contact clamps and said current conducting rails wherein said pressure producing means are operative to transfer current to said contract clamps by contact of said contact sections against said current-conducting rails.

2. The holder assembly of claim 1 wherein the rails are electrically insulated from the cooling shield.

3. The holder assembly of claim 1 wherein the pressure producing means force the contact clamps toward the electrode and the contact sections against the current-conducting rails.

4. The holder assembly of claim 1 wherein the cooling shield is an integral part of the furnace roof.

5. The holder assembly of claim 1 wherein the cooling shield with rails thereon extends downwardly into the furnace at least as low as the contact clamps are intended to be moved downwardly.

6. The holder assembly of claim 1 wherein the number of current conducting rails disposed on the cooling shield corresponds to the number of contact clamps.

7. The holder assembly of claim 1 wherein the number of current conducting rails are a multiple of the number of contact clamps.

* * * * *